US006838831B2

(12) United States Patent
Brandenburg et al.

(10) Patent No.: US 6,838,831 B2
(45) Date of Patent: Jan. 4, 2005

(54) APPARATUS AND METHODS FOR GENERATING PERSISTENT IONIZATION PLASMAS

(75) Inventors: John E. Brandenburg, Springfield, VA (US); John F. Kline, Hopewell, NJ (US); Joshua H. Resnick, Annandale, VA (US)

(73) Assignee: Physical Sciences, Inc., Andover, MA (US)

( * ) Notice: Subject to any disclaimer, the term of this patent is extended or adjusted under 35 U.S.C. 154(b) by 328 days.

(21) Appl. No.: 10/178,438

(22) Filed: Jun. 24, 2002

(65) Prior Publication Data

US 2002/0167277 A1 Nov. 14, 2002

Related U.S. Application Data

(62) Division of application No. 09/301,998, filed on Apr. 29, 1999, now Pat. No. 6,441,552.
(60) Provisional application No. 60/083,631, filed on Apr. 30, 1998.

(51) Int. Cl.[7] ..... H01J 7/24
(52) U.S. Cl. ..... 315/111.21; 315/111.51; 118/723 I
(58) Field of Search ..... 315/111.21, 111.51, 315/111.71; 118/723, 723 I, 723 E, 723 IR

(56) References Cited

U.S. PATENT DOCUMENTS

| | | | | |
|---|---|---|---|---|
| 4,954,320 A | | 9/1990 | Birmingham et al. | 422/186.04 |
| 5,639,519 A | * | 6/1997 | Patrick et al. | 427/569 |
| 5,998,933 A | * | 12/1999 | Shun'ko | 315/111.51 |
| 6,041,735 A | | 3/2000 | Murzin et al. | 118/723 I |
| 6,230,719 B1 | | 5/2001 | Wensel | 134/1.1 |
| 6,247,671 B1 | * | 6/2001 | Saeks et al. | 244/205 |
| 6,570,333 B1 | * | 5/2003 | Miller et al. | 315/111.21 |
| 2004/0011917 A1 | * | 1/2004 | Saeks et al. | 244/1 N |

FOREIGN PATENT DOCUMENTS

| | | | |
|---|---|---|---|
| JP | 5-144785 | 6/1993 | 315/111.21 |

OTHER PUBLICATIONS

Brandenburg, John E. et al., "An Investigation of PIA (Persistent Ionization in Air) Plasmas Using Room Air," 25$^{th}$ Anniversary IEEE International Conference on Plasma Science, Abstract, pp. 303 (1998).
Brandenburg John E. et al., "Experimental Investigation of Large–Volume PIA Plasmas at Atmospheric Pressure," IEEE transactions on Plasma Science, vol. 26, No.2, 145–149 (Apr. 1998).
Brandenburg John E. et al., "[G4S.62] Progress on the CMTX (Colliding Micro–Tori eXperiment)," www.aps.org/BAPSDPP98/abs/S3200062.html, retrieved on Feb. 10, 2000 (abstract of poster paper presented Nov. 17, 1998).
Lewis, Jon M. et al., "Temperature Measurement and Characterization of Large Volume Microwave Discharges," AIAA 99–3432, 30$^{th}$ Plasmadynamics and Lasers Conference, held on Jun. 28/Jul. 1, 1999 at Norfolk, VA (1999).
Nossair et al., "Modulation of the Plasma emerging from a duoplasmatron," *Int. J. Electronics*, 51(2) 185–191 (Aug. 1981).

* cited by examiner

*Primary Examiner*—Don Wong
*Assistant Examiner*—Jimmy T. Vu
(74) *Attorney, Agent, or Firm*—Proskauer Rose LLP

(57) ABSTRACT

A persistent ionization plasma generator is described that forms a plasma in a cavity that persists for a time after termination of the exciting RF electric field. The plasma generator includes a RF cavity that is in fluid communication with a source of ionizing gas. The RF cavity can be at substantially atmospheric pressure. An RF power source that generates an RF electric field is electromagnetically coupled to the RF cavity. An ultraviolet light source is positioned in optical communication to the cavity. An antenna is positioned within the cavity adjacent to the ultraviolet light source. A chamber for confining the plasma can be positioned in the cavity around the antenna.

20 Claims, 7 Drawing Sheets

APPARATUS AND METHODS FOR GENERATING PERSISTENT IONIZATION PLASMAS

CROSS-REFERENCE TO RELATED APPLICATIONS

The subject application is a divisional of U.S. patent application Ser. No. 09/301,998, filed Apr. 29, 1999, now U.S. Pat. No. 6,441,552 issued Aug. 27, 2002, which application is incorporated herein in its entirety by reference, and which application claims priority of provisional patent application Ser. No. 60/083,631, filed Apr. 30, 1998, the entire disclosure of which is incorporated herein by reference.

FIELD OF THE INVENTION

This invention relates generally to the field of plasma generation, and in particular, to apparatus and methods for generating persistent ionization plasmas.

BACKGROUND OF THE INVENTION

Persistent ionization in air (PIA) plasmas are plasmas that are formed at atmospheric pressures and that persist for a finite time after termination of the power source. Large volume PIA plasmas have generated research interest because they are useful for simulating a phenomenon known as ball lightning, which is commonly observed in thunderstorms. In ball lightning, air and other gases are observed under certain conditions to have high levels of ionization for periods that are very long compared to the recombination times of the electrons. This is similar to the low loss electron phenomenon, which is readily observed in PIA experiments in the laboratory.

In ball lightning, electron recombination times in air, hastened by electron attachment to oxygen and water, are on the order of 10 microseconds. But appreciable levels of ionization appear to precede the main lightning discharge by 10 msec and persist for periods of 10 msec or longer afterwards. This is called the stepped leader phenomenon. This phenomenon and the unexplained interval between discharges is commonly observed in lightning storms.

Several theoretical models have been proposed in the past for ball lightning. These models suggest the involvement of RF radiation. An early theory explained ball lightning as an evacuated microwave resonant cavity surrounded by a layer of plasma. Another theory proposed that vorticity can play a part. A recent theory describes ball lightning as an electromagnetic knot, with tangled magnetic fluxes. The electromagnetic knot model predicted an expansion of the plasma as it cools, in the limit of infinite conductivity.

The process of plasma formation in air by microwaves has also been extensively investigated, both experimentally and theoretically. As a result, it is known that the formation of plasmas in air, $O_2$, and $N_2$ are fairly similar. Breakdown is achieved at lower field strengths with lower frequencies: approximately 1000 V/cm will achieve breakdown in room air at 0.992 GHz, whereas approximately 3000 V/cm is required at 9.4 GHz.

A number of researchers have produced PIA plasmas using high-frequency electromagnetic fields at atmospheric pressure to simulate ball lightning. Kapitza originally formulated a theory that ball lightning forms from RF waves in the atmosphere. Tesla made the earliest report of an artificial creation of ball lightning. Later, Powell and Finkelstein succeeded in making spherical discharges that would separate from the electrodes where they formed. They used 75 MHz RF at 20 kW and a 15-cm-diameter Pyrex tube to form the plasmas. Powell and Finkelstein found that the large volume plasmas produced in those experiments persisted for as much as 0.5 seconds after termination of the ionizing radiation.

In more recent experiments, researchers used a 1–5 kW 2.45-GHz power source to drive a resonant cavity, but did not restrict the physical extent of the plasmas formed. The researchers created large air discharges in the resonant cavity. These discharges were often augmented by ordinary combustion. Other researchers have used helium gas as a plasma medium at atmospheric pressure.

In previous experiments for creating PIA plasmas, high-power sources, resonant cavities, or specialized gases were needed in order to create large plasmas at atmospheric pressure. No method or device currently exists for creating PIA plasmas with commercially available equipment, such as commonly available gases and power sources. Further, previous research efforts have not succeeded in measuring the properties of the created plasmas. Accordingly, there currently exists a need for apparatus and methods for creating PIA plasmas efficiently and economically, and for measuring the properties of the created PIA plasmas.

SUMMARY OF THE INVENTION

It is a principal object of the present invention to efficiently and economically generate steady state plasmas that are formed at atmospheric pressure and that persist for a finite time after termination of the power source (i.e. persistent ionization in air, PIA, plasmas). It is another principal object of the invention to create a steady state plasma where the electrons in the plasma have poor thermal transfer to the neutral atoms, thereby keeping the ambient gas temperature low. It is yet another principle object of the invention to provide apparatus and methods for measuring the properties of the generated PIA plasmas, such as plasma lifetimes after termination of the driving electric fields, and densities of electrons and ions.

It is yet another object of the invention to create a large volume steady state plasma that persist for a time after creation, without the use of discharge electrodes. It is another object of the invention to use such plasmas as shields against microwave beams. It is another object of the invention to use such plasmas to reduce the aerodynamic drag of aircraft. It is another object of the invention to use such plasmas to generate high efficiency illumination. It is another object of the invention to use such plasmas as an excited source for a gas laser. It is another object of the invention to use such plasmas to produce ozone for toxic gas abatement.

Accordingly, the present invention features a persistent ionization plasma generator that includes a RF cavity that is in fluid communication with a source of ionizing gas. The cavity can be substantially at atmospheric pressure. An RF power source that generates an RF electric field is electromagetically coupled to the RF cavity. The RF power source can operate at 2.45 GHz or at 915 MHz. An ultraviolet light source is positioned in optical communication to the cavity.

The ultraviolet light source can be a spark plug or a laser. A nozzle that is coupled to the source of ionizing gas can be positioned to inject the ionizing gas into the cavity proximate to the ultraviolet light source. An antenna is positioned within the cavity adjacent to the ultraviolet light source. A chamber for confining the plasma can be positioned in the cavity around the antenna and the ultraviolet light source. The chamber can be positioned at an angle relative to the cavity in order to cause a vortex flow of the ionizing gas in the chamber. A plasma is formed in the cavity that persists for a time after termination of the RF electric field.

The present invention also features a method of generating a persistent ionization plasma. The method includes injecting an ionizing gas into a RF cavity. The ionizing gas can be mixed with ambient air in the cavity. A vortex flow of the ionizing gas can be formed in the cavity. An RF electric field is electromagnetically coupled to the cavity. An antenna is provided that assists in the ignition of a plasma. Ultraviolet radiation is then optically coupled into the cavity in order to cause ignition of a plasma.

The RF electric field is terminated and the plasma persists for a time after termination, which can be greater than 1 ms. The plasma can persist for a time after termination of the RF electric field because electron motion in the plasma resulting from collisions between free electrons and electrons bounded to neutrals is decoupled.

The present invention also features a method for reducing aerodynamic drag of an aircraft. The method includes positioning an antenna on a surface of an aircraft. A RF electric field is electromagnetically coupled to the surface of the aircraft proximate to the antenna. Ultraviolet radiation is also optically coupled to the surface of the aircraft proximate to the antenna in order to cause ignition of a plasma. The RF electric field is terminated and the plasma persists for a time after termination. The electrons in the plasma that persists for a time after termination of the RF electric field have reduced thermal transfer to neutral atoms and, therefore, reduce aerodynamic drag on surface of the aircraft.

The present invention also features a method of exciting a gas laser. The method includes injecting an ionizing gas into a laser cavity. A vortex flow of the ionizing gas can be induced in the cavity. A RF electric field is electromagnetically coupled to the laser cavity. An antenna is provided in the laser cavity that assists in the ignition of a plasma. A pump laser beam is optically coupled into the laser cavity in order to cause ignition of a plasma. The RF electric field is terminated and the plasma persists for a time after termination. The plasma causes laser oscillations in the laser cavity.

The present invention also features a method of toxic gas abatement. The method includes injecting an ionizing gas and a toxic gas into a RF cavity. A vortex flow of the ionizing gas can be induced in the cavity. A RF electric field is electromagnetically coupled to the cavity. An antenna is provided in the laser cavity that assists in the ignition of a plasma. Ultraviolet radiation is then optically coupled into the cavity in order to cause ignition of a plasma. The RF electric field is terminated and the plasma persists for a time after termination. The plasma abates the toxic gas.

In addition, the present invention features a method of characterizing a persistent ionization plasma. The method includes forming a RF electric field generated plasma in a cavity. An illuminator is positioned in the cavity that radiates optical radiation when exposed to RF electric field. The optical radiation generated by the illuminator and by the plasma is recorded by a recording device. The time period during which the plasma persists after termination of the RF electric field is determined by counting frames that record the radiation being generated by the plasma while substantially no radiation is being generated by the illuminator. The method can include the step of inserting a Langmuir probe into the plasma to measure density and temperature of electrons in the plasmas during the time period. The method can also include the step of inserting a loop probe into the plasma to measure the electric field in the plasmas during the time period.

BRIEF DESCRIPTION OF THE DRAWINGS

This invention is described with particularity in the appended claims. The above and further advantages of this invention can be better understood by referring to the following description taken in conjunction with the accompanying drawings, in which:

DETAILED DESCRIPTION

Figure 1:
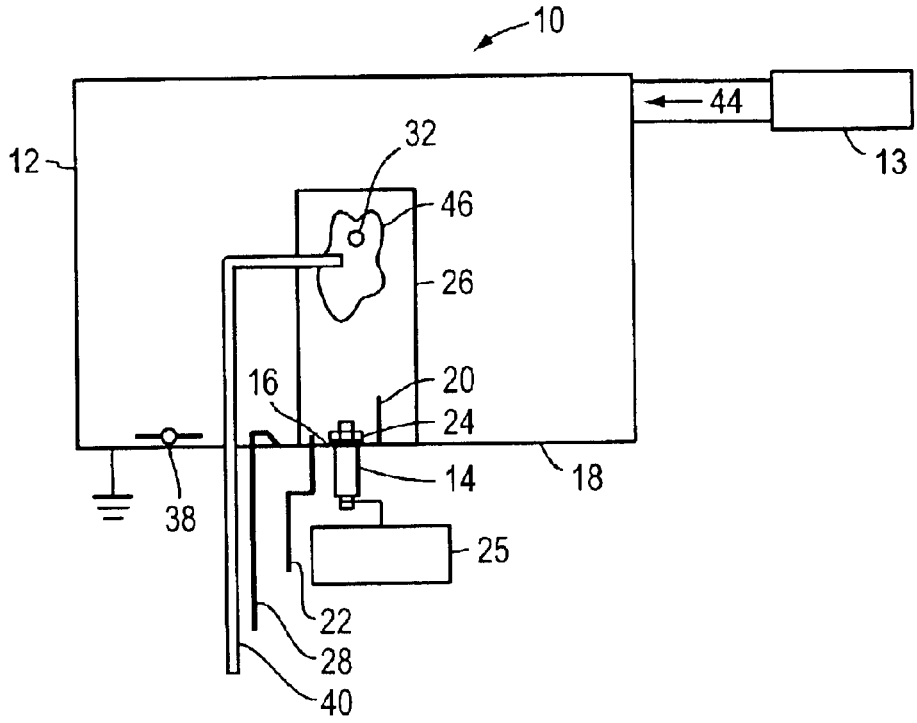
FIG. 1 is a side view of an embodiment of a plasma generator for generating a persistent ionization plasma of the present invention.

FIG. 1 illustrates a side view of an embodiment of a plasma generator 10 according to the present invention for generating a high power density PIA plasma at approximately one atmosphere. The plasma generator includes a RF cavity 12 for confining a microwave or RF electric field. The plasma generator also includes a RF power source 13. In one embodiment, a microwave oven that produces an untuned microwave field in a microwave-sealed cavity can provide both the RF cavity and the RF power source. For example, the RF cavity of the microwave oven can be approximately 27 cm tall, 39 cm wide, and 37 cm deep, the RF power output of the oven can be 1000 kWatts, and the operating frequency can be 2.45 GHz. In another embodiment of the present invention, the operating frequency of the RF cavity can be 0.915 GHz.

An ultraviolet (UV) light source 14 is in optical communication with the microwave cavity 12. In one embodiment, the outer case of a microwave oven is removed on the bottom, in order to allow access to the cavity floor. The turntable motor assembly is then removed, leaving a hole 16 in the center of the cavity floor 18. The UV light source 14 is inserted into the cavity through the hole 16. In one embodiment, the UV light source 14 is a spark plug, such as a Champion model DJ7Y spark plug. The spark plug can be clamped in place with a nut 24 inside the cavity 12. The spark plug can be energized using a 4000-V half-wave rectified power supply 25, which is commonly available in microwave ovens. In another embodiment, the UV light source is a laser.

A microwave antenna 20 is positioned in close proximity to the UV light source. In one embodiment, the microwave antenna 20 is a sheet metal screw. The sheet metal screw can be introduced into the cavity floor 18, oriented upwards, at a distance of approximately 2.5 cm away from the center of the UV light source 14. In one embodiment, the metal screw is a number 6 screw and is 1 inch long. The antenna 20 concentrates the microwave field near the UV light source at a strength sufficient to cause microwave breakdown at approximately one atmosphere pressure. At atmospheric pressure, the electric field required to break down a gas using 2.45 GHz microwaves is very high. The UV light from the UV light source 20, however, photoionizes some of the gas near the antenna, which lowers the electric field strength required to break down the gas.

The plasma generator includes a nozzle 22 that is coupled to the microwave cavity 12. The nozzle 22 introduces one or more ionizing gases into the cavity. In one embodiment, the nozzle 22 is a ⅛ inch copper tube. A small hole is drilled in the floor in the side of the antenna mounting nut 24, approximately 4.5 cm away from the center of the UV light source. The nozzle is inserted into the floor through this hole, thereby allowing the introduction of a gas into the center of the cavity proximate to the light source 14.

A chamber 26 can be placed vertically in the microwave cavity to contain the plasma. The chamber 26 is positioned on the floor 18 of the cavity 12, and surrounds the UV light source 14, the antenna 20, and the nozzle 22. In one embodiment, the chamber is a Plexiglas tube. Confining the plasma within chamber 26 increases its stability. The chamber confines the plasma so that free fireballs do not migrate within the microwave cavity. In one embodiment, the Plexiglas tube is approximately 7.6 cm in diameter and 26 cm long. In another embodiment, the confining chamber 26 is a flared-shaped glass vessel, comprising a thin glass lamp shroud. The flared shape of the glass vessel results in plasmas having larger volumes.

The plasma generator 10 of the present invention can include measurement and diagnostic instruments that measure the properties of the generated PIA plasmas, such as plasma lifetimes after microwave cutoff, and densities of electrons and ions. For example, the plasma generator can include a microwave detector 28 that measures the microwave field after microwave cutoff. In one embodiment, the microwave detector can be a wire loop probe coupled to a diode. A light detector 32 can be used to measure visible light output from the plasmas after termination of the RF field. In one embodiment, the light detector can be an amplified photoresistor circuit. The photoresistor circuit can be attached to the outside of the microwave-shielded oven door, near the center of the plasma. A digital oscilloscope can collect the output of both the microwave detector 28 and the light detector 32 to determine the time that the plasma continues to emit visible light after termination of the RF electric field.

In one embodiment of the present invention, a video camera is positioned to image the plasma in the cavity, to assist in obtaining accurate measurements. The video camera insures that other light sources do not interfere with the output of the light detector, and confirms that the plasma in the oven was the only source of light over the period of its measured lifetime. The signals arriving at the oscilloscope from the microwave detector and the light detector can be shielded from noise generated by the high-voltage transformer of the RF power source 13.

As a verification of the direct measurements, a small neon lamp 38 can be positioned in the RF cavity in one embodiment of the present invention to measure the time interval between termination of the RF field and dissipation of microwave power from the cavity. The lamp can be powered by the RF field, which can be picked up by the bare leads of the lamp. The video camera measures the light from the neon lamp. In one embodiment, the video camera has a frame rate of 60 Hz. The RF field extinguished after one frame, corresponding to 17 msec, whereas the PIA plasma persisted for approximately 12 frames beyond the extinction of the lamp.

A Langmuir probe 40 can be positioned in the cavity to measure the electron properties of the generated PIA plasmas. The Langmuir probe can be inserted into the side of the chamber 26 near the center of the plasma. In one embodiment, the Langmuir probe 40 comprises a coaxial cable conductor, with the shielding grounded to the walls of the microwave cavity. The coaxial cable conductor can be extended by using a brass rod. The rod can be insulated from the shielding by a glass tube, preferably 0.6 cm in diameter. The cable shielding can be extended, preferably by using a 1 cm-diameter brass tube. The glass insulator tube can be extended to near the center of the chamber, beyond the end of the brass rod. The coaxial cable conductor can be extended to the center of the plasma, beyond the end of the glass insulator tube. A hole can be drilled in the side of the chamber to allow the insertion of the brass rod shielding of the probe.

Once the center conductor rod is extended radially into the center of the chamber, the probe is biased, for example to ±60V DC. The voltage generated by the probe is measured across a 1-MOhm resistor. The probe measurements, taken point by point, are used to measure the electron density and temperature. A maximum electron density of $1.0\times10^{10}$ $cm^{-3}$ was found at a 0.67-eV temperature using argon-air mixture at 1.0 L/min of argon. The Langmuir probe 40 can also be used as an antenna to measure RF electric fields near and inside the plasma.

A RF survey meter 42 can be positioned outside the microwave cavity containing the Langmuir probe, and can be used to measure RF leaking along the probe. A diagnostic measurement of RF leaking provides a check for the results for the plasma electron density. The RF leakage through the Langmuir probe output decreased below 0.5 $mW/cm^2$ while the plasma was surrounding the probe, but increased to over 5 $mW/cm^2$ when there was no plasma near the probe. The PIA plasma generated according to the present invention thus blocks the radio waves from reaching the probe. Accordingly, the electron density is of the order of $7.4\times10^{10}$ $cm^{-3}$, rather than $1.0\times10^{10}$ $cm^{-3}$. An electron density of $7.4\times10^{10}$ $cm^{-3}$ corresponds to a plasma frequency of 2.45 GHz, which matches the frequency of the RF electric field and therefore reflects the radio waves.

Figure 2:
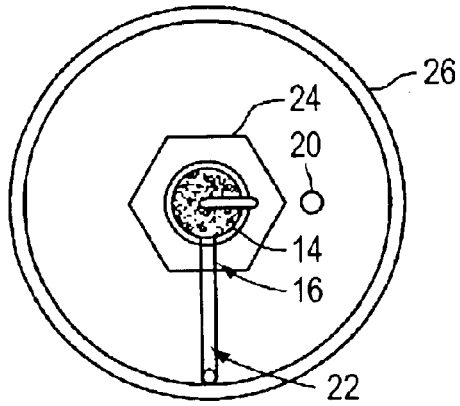
FIG. 2 is a cross sectional diagram of a portion of the plasma generator of FIG. 1 as viewed from the top.

FIG. 2 is a top view of a cross sectional diagram of the plasma generator of FIG. 1. The chamber 26 surrounds the antenna 20, the UV light source 14, and the nozzle 22. Also visible is the nut 24 that clamps the chamber 26 in place inside the RF cavity, and the hole 16 that is drilled in the side of the nut. In one embodiment, the axis of the chamber 26 is slightly offset from the axis of the UV light source, in order to generate vortex gas flow.

In operation, the RF electric field 44 is first initiated by activating the RF power source 13. The UV light source 14 is then activated momentarily. This causes a discharge 46 near the antenna 20, which causes a plasma to strike in the chamber 26. To improve the probability that a plasma will strike, an object having numerous sharp points can be positioned in the chamber to create field concentrations near the UV light source to initiate a few discharges. The object can provide numerous current paths to ground for the discharges as they initiate.

The plasma generator of FIGS. 1 and 2 created detached discharges with numerous ionization gas mixtures. For example, ambient stagnant air and mixtures of air with argon, helium, and nitrogen were used. The pure gases were introduced via the nozzle 22 through the UV light source 14 and mixed with chamber air. The plasmas generated were typically yellow-white, red or blue in color.

A low flow rate resulted in a discharge 46 that drifted upwards through the chamber, impacted with the metal top of the cavity like a liquid, and then dissipated. A high flow rate resulted in the plasma being closer to the bottom of the chamber. Stable discharges filling much of the chamber were obtained with a flow of approximately 1.2 L/min. The plasmas were sharply defined, but turbulent. The basic form appeared to be nearly spherical, but the most intense portion in the core of the PIA plasmas appeared to have the form of a toroid. The PIA plasmas generated very little heat.

A vortex flow was generated in the chamber 26 by introducing a vortex structure. In one embodiment, the vortex structure was introduced via an offset placement of the chamber 26 with respect to the UV light source 14. PIA plasmas formed reproducibly in the presence of the vorticity, and once formed, rotated turbulently inside the chamber. Vortex structures are advantageous for generating PIA plasmas according to the present invention, because of their observed utility in trapping and transporting PIA plasmas. Like smoke rings, vortex rings can transport substances through fluid media and move rapidly and persistently in air or other fluids, thereby helping to trap and transport PIA plasmas. In addition, vortex stabilized flow fields are advantageous because of their ability to minimize losses due to impurities and thermal conduction to solids. The mechanism for vortex stabilization is a low pressure zone that forms in the core of a vortex where centrifugal forces tending to expand the vortex are balanced by a pressure imbalance caused by low core pressure. The plasma tends to find a stable equilibrium in this vortex core because a low core pressure requires a low density, which facilitates ionization.

Accordingly, one embodiment of the present invention uses a vortex structure to generate and launch PIA plasmas of large volume into open air at atmospheric pressure. The plasma volume can be greater than 10 liters. Electron densities of $n_e>10^{12}$ $cm^{-3}$ at powers of 75 kW or less has been observed in these vortex structured PIA plasmas generated by the plasma generator of the present invention.

Figure 3:
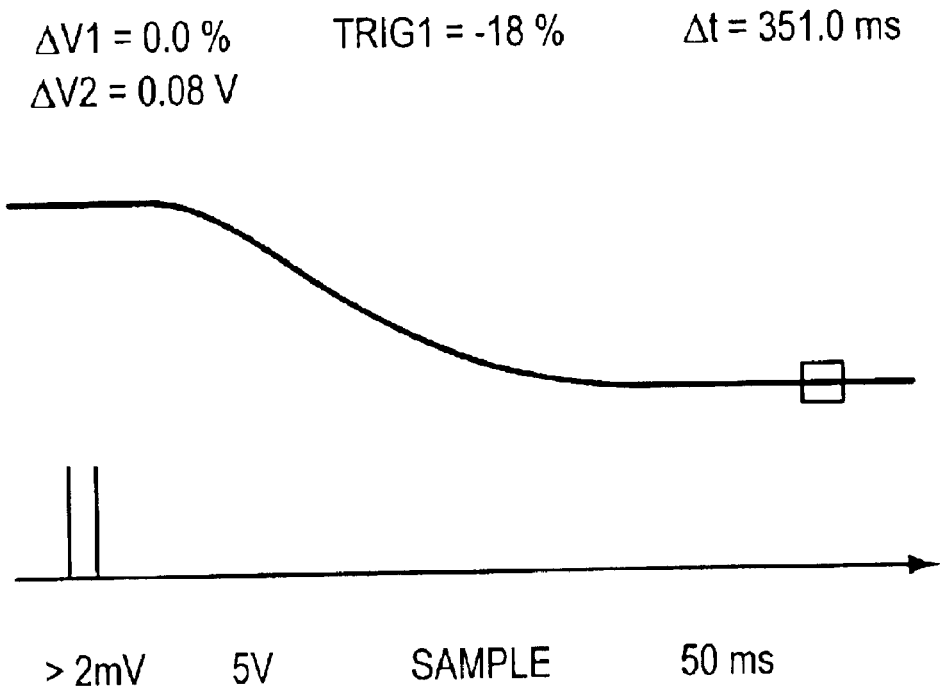
FIG. 3 presents measurements of plasma lifetime for a plasma formed according to the present invention from stagnant air.
Figure 4:
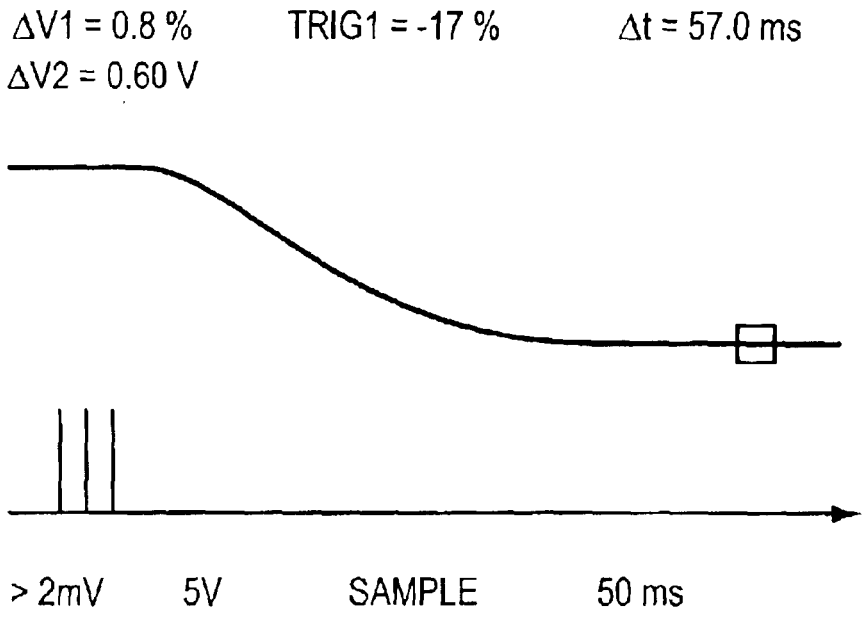
FIG. 4 presents measurements of plasma lifetime for a plasma formed according to the present invention from Argon.

FIGS. 3 and 4 illustrate measurements of plasma emission taken with the light detector 32 during a stable discharge, after the RF electric field was terminated. The RF cavity was operated using a 60-Hz half-wave rectified power supply. FIG. 3 illustrates the plasma lifetime, which is related to exponential decay of optical emission. The plasma lifetime was found to be approximately 200 ms for stagnant ambient air. The decay time to half amplitude was approximately 60 ms.

FIG. 4 illustrates the lifetime for Argon, which was also approximately 200 ms. The half-amplitude decay time was 60 ms. A video camera was used to measure the plasma lifetime. The video camera, operating at a rate of 60 Hz, showed that the average argon lifetime was 12 frames after termination of the RF electric field, corresponding to approximately 200 ms. The video camera was also used to measure the extent of the plasma. A plasma volume of approximately 800 $cm^3$ was measured, using a flow rate of 1.0 L/min of argon.

Optical emission spectra generated by PIA plasmas formed by argon-air mixtures showed strong lines for atomic O and CN with a strong continuum background. Molecules of CN are normally formed by low-temperature thermal breakdown of $CO^2$ and $N_2$, and are very strong radiators. Argon lines were not visible in the scan. These results indicate a low neutral temperature.

The observed cool ambient gas temperature and the long plasma lifetime after termination of the RF electric field suggest that the existence of PIA plasmas is caused, at least in part, by a decoupling of electron motion that results from collisions between free electrons and electrons bounded to neutral atoms or ions. The free electrons in the PIA plasma appear to have very long recombination times, as indicated by the long plasma lifetimes observed. The free electrons also appeared to have long collisional energy transfer times, as shown by the fact that the thin glass or Plexiglas tubes used to confine the PIA plasmas suffered little or no thermal damage. This indicates that the ambient neutral gas did not rise in temperature above a few hundred degrees.

The electrons in a PIA plasma generated according to the present invention thus do not appear to recombine or even to equilibrate in the temperature with the neutral gas in which they sit, but rather appear to move in something analogous to effectively ionized orbitals. The electrons behave like electrons in a good conductor, such as copper or silver, even though they are not actually at an ionization energy. These ionized electron orbitals can occur in gases of excited atoms, and therefore are a collective effect.

This phenomenon has been explained as the lowering of ionization potentials in a dense gas. The lowering occurs because the atomic orbitals of outer electrons reach a very large size in an excited state approaching ionization, thereby overlapping the orbitals of their nearest neighbors. An electron in such an excited state can therefore have its orbit perturbed by its nearest neighbor and behave effectively as a free electron, even though it is not actually at an ionization energy. The effective electron ionization energy is $\Delta I=7\times 10^{-6}\ n^{1/3}$ eV where n is the particles per cc in an excited gas. For air at standard temperature and pressure, this will lower the effective ionization potential. Since the PIA effect has so far been reported only in dense gases, this collective state of excited gas atoms with large overlapping orbitals could have a metastable condition, as in solid or liquid metals.

Accordingly, the PIA plasmas generated according to the present invention can be explained by the MLO (Metastable Large Orbital) hypothesis. In this hypothesis, the electrons responsible for electrical conduction in PIA plasmas are in a state resembling conduction band electrons in liquid metals. The electrons are not above ionization energy, yet they are not localized to any particular ion or neutral. The shared electrons do not interact strongly with electrons in more tightly bound states around the ions and neutrals and therefore are not captured or scattered by them. The shared electrons effectively behave like conduction electrons in liquid metals. This decoupling of the electron motion resulting from collisions between free electrons and neutrals is indicated by the observed persistence of the discharges, which last much longer than an ordinary arc discharge. Low thermal loading of the glass and the Plexiglas chambers, and high levels of continuum radiation in the PIA spectra further support the MLO explanation for the PIA plasmas generated according to the present invention.

Figure 5:
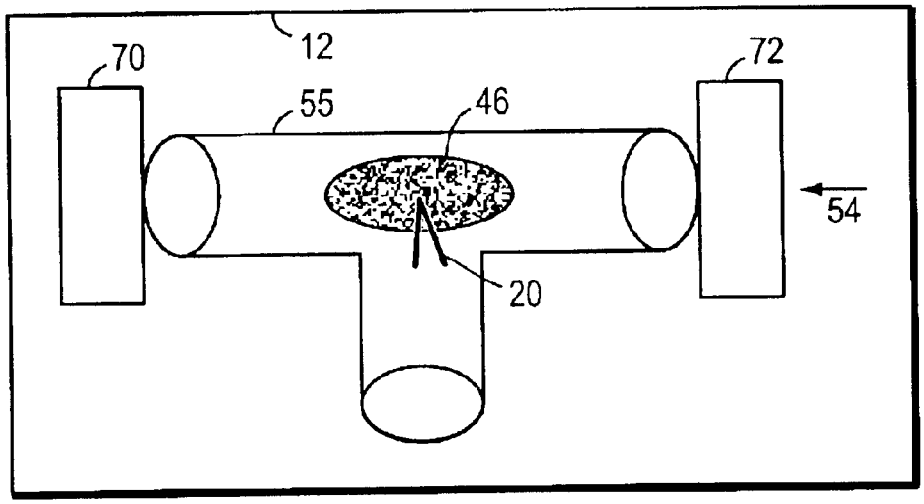
FIG. 5 illustrates an embodiment of the invention where a persistent ionization plasma is used as an excited source for a gas laser.

A major advantage of the plasma generator 10 of the present invention is the low thermal transfer of the electrons in the plasma to the neutral atoms. The low thermal transfer keeps the ambient gas temperature low, and gives rise to numerous applications of the apparatus and methods of the present invention. In one embodiment, the plasma generator can be used as an excited source for a gas laser. FIG. 5 illustrates an embodiment of the present invention in which a PIA plasma is used as an excited source for a gas laser. An RF electric field is turned on within a laser cavity 55, into which ionizing gas has been injected. The laser cavity contains an antenna 20. When an incident laser beam 54 is optically coupled with the laser cavity, thereby providing a source of UV light, a PIA plasma 46 is ignited that persists after termination of the RF electric field. The PIA plasma causes laser oscillations in the cavity whereby mirrors 70 and 72 reflect light from the laser. The PIA plasma generated according to the present invention produces a high power density discharge at atmospheric pressure. This discharge contains a high density of excited atoms with low ambient gas temperature. Therefore in a gas laser, the PIA plasma generated according to the present invention will significantly reduce the size of the laser when compared with existing gas lasers that use low-pressure plasmas.

Figure 6:
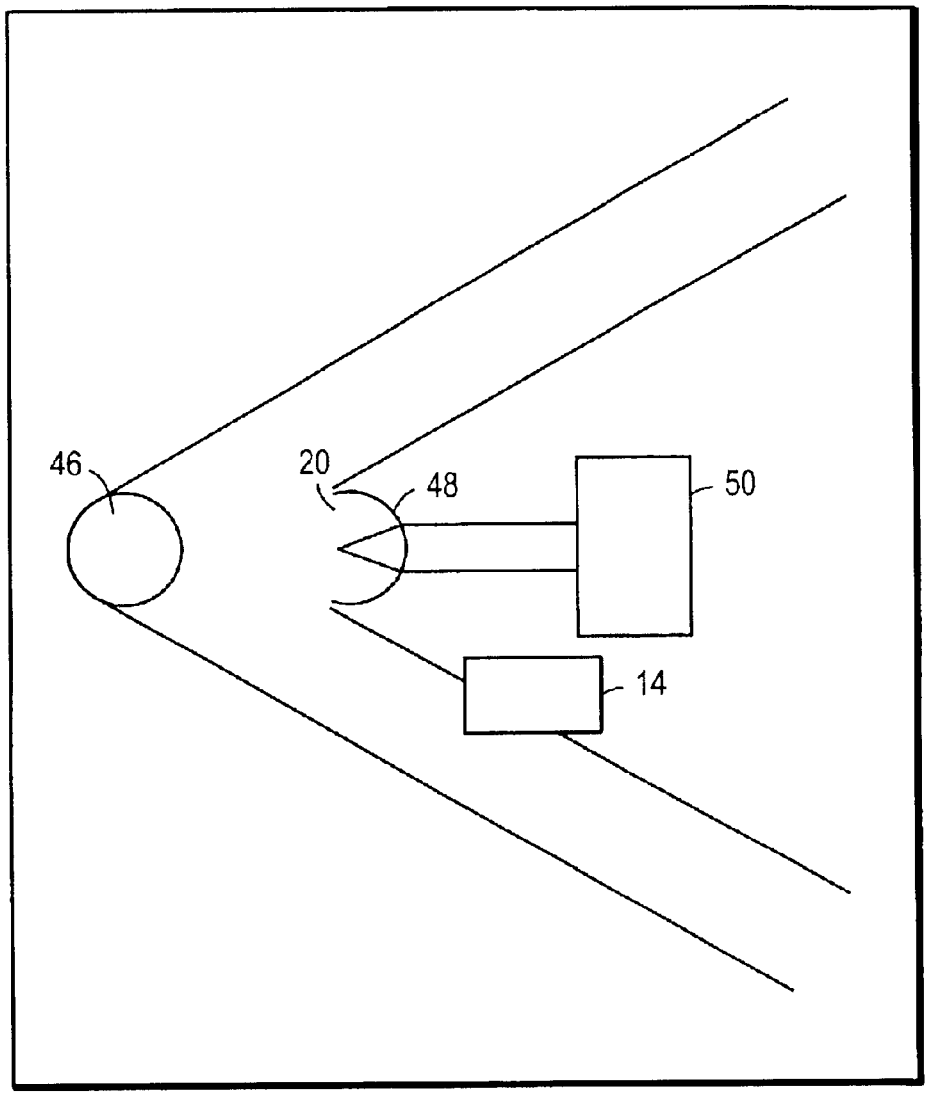
FIG. 6 illustrates an embodiment of the invention where a persistent ionization plasma is used for hypersonic drag reduction in aircraft.

In another embodiment of the invention, persistent ionization plasmas can be used to reduce transonic drag. FIG. 6 is a diagram illustrating transonic drag reduction using PIA plasmas generated according to the present invention. An antenna 20 is positioned on a surface of the aircraft, for example the surface of the nose cone 48 of the aircraft. An RF electric field is provided to the surface of the aircraft in proximity to the antenna 20. In one embodiment, the RF electric field is provided from a magnetron 50 through a waveguide 52. Ultraviolet radiation is then provided to the surface in proximity to the antenna 20, so as to ignite a PIA plasma 46 of the present invention. The lack of heat transfer to neutrals means that the electrons are capable of transferring energies to much longer distances in the gas than was previously thought possible. The PIA generator of the present invention can be used to reduce aerodynamic drag of an aircraft traveling in the transonic regime. Because the energy costs of the discharge creation will be less than the reduction in energy loss due to drag reduction, more fuel efficient supersonic and hypersonic flight will result.

Figure 7:
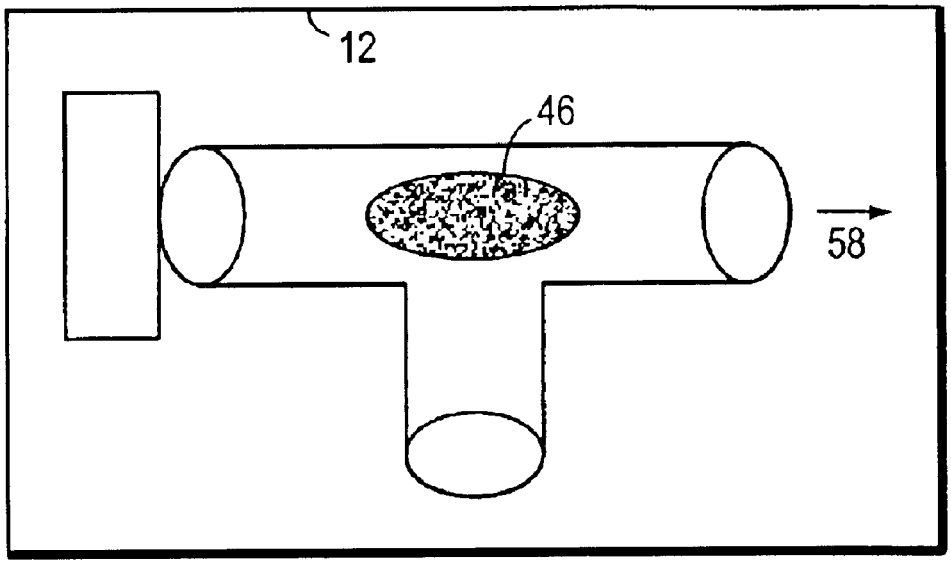
FIG. 7 illustrates an embodiment of the invention where a persistent ionization plasma is used as a high efficiency light source.

In another embodiment of the invention, persistent ionization plasmas generated according to the present invention can be used for illuminations. FIG. 7 illustrates an embodiment of the present invention in which the plasma generator of the present invention is used to produce high efficiency illumination. Using the plasma generator of the present invention, a plasma discharge 46 caused by introducing a mixture of argon and ambient air into the RF cavity 12 produces a strong continuum emission of light 58, which is useful for illuminations. The plasma generator 10 of the present invention thus can be used for high efficiency white light illumination, with low heat losses.

Figure 8:
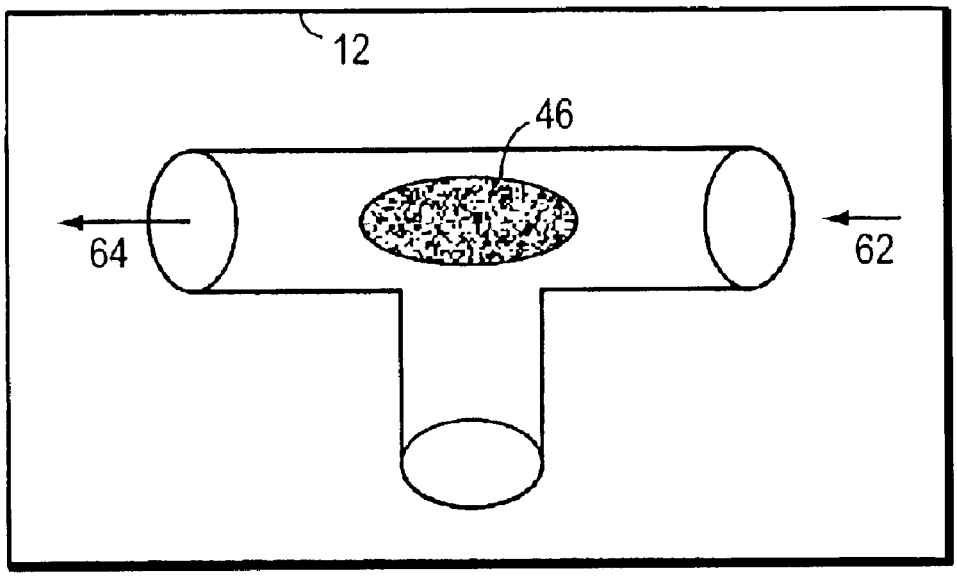
FIG. 8 illustrates an embodiment of the invention where a persistent ionization plasma is used for toxic gas abatement.

In yet another embodiment of the invention, persistent ionization plasmas generated according to the present invention can be used for toxic gas abatement. FIG. 8 illustrates an embodiment of the present invention in which a PIA plasma is used for toxic gas abatement. Using the plasma generator of the present invention, the discharge 46 created by introducing a mixture of argon and ambient air into the RF cavity 12 produces a strongly oxidizing environment. This results in the production of ozone at a low ambient gas temperature. The ozone can be used for toxic gas abatement in chemical reactions that reduces hazardous compounds, such as chlorinated hydrocarbons, to a less hazardous component species, without raising the temperature of the environment. A reactant gaseous species 62 containing hazardous compounds can be introduced in the same manner as Argon in the present invention. A reduced emissions gas 64 can then be collected at another location in the confining chamber.

Equivalents

While the invention has been particularly shown and described with reference to specific preferred embodiments, it should be understood by those skilled in the art that various changes in form and detail can be made therein without departing from the spirit and scope of the invention as defined by the appended claims.

What is claimed is:

1. A method for reducing aerodynamic drag of an aircraft, the method comprising:

positioning an antenna on a surface of an aircraft;

electromagnetically coupling a RF electric field to the surface of the aircraft proximate to the antenna;

optically coupling ultraviolet radiation to the surface of the aircraft proximate to the antenna, thereby causing ignition of a plasma; and terminating the RF electric field, thereby generating a plasma that persists for a time after termination of the RF electric field, and reducing aerodynamic drag on the surface of the aircraft.

2. The method of claim 1 wherein optically coupling the ultraviolet radiation comprises optically coupling ultraviolet radiation produced by a spark plug to the surface of the aircraft.

3. The method of claim 1 wherein optically coupling the ultraviolet radiation comprises optically coupling ultraviolet radiation produced by a laser to the surface of the aircraft.

4. The method of claim 1 wherein the RE electric field has a frequency of 2.45 GHz.

5. The method of claim 1 wherein the RF electric field has a frequency of 915 MHz.

6. The method of claim 1 wherein the time after termination is greater than about 1 ms.

7. The method of claim 1 further comprising the step of operating the aircraft.

8. The method of claim 7 wherein the step of operating the aircraft comprises operating the aircraft in a transonic regime.

9. The method of claim 7 wherein the step of operating the aircraft comprises operating the aircraft in a supersonic regime.

10. The method of claim 7 wherein the step of operating the aircraft comprises operating the aircraft in a hypersonic regime.

11. A system for reducing aerodynamic drag on an object, comprising:

an antenna positioned on a surface of an object;

an RF generator in electrical communication with the antenna, the RF generator producing an RF electric field that electromagnetically couples to the surface of the object proximate to the antenna; and an ultraviolet radiation source that optically couples ultraviolet radiation to the surface of the object proximate to the antenna, thereby causing ignition of a plasma;

whereby the plasma persists for a time after termination of the RF electric field, reducing aerodynamic drag on the surface of the object.

12. The system of claim 11 wherein the ultraviolet radiation source comprises a spark plug.

13. The system of claim 11 wherein the ultraviolet radiation source comprises a laser.

14. The system of claim 11 wherein the RF generator is adapted to operate at a frequency of 2.45 GHz.

15. The system of claim 11 wherein the RF generator is adapted to operate at a frequency of 915 MHz.

16. The system of claim 11 wherein the persistence time after termination is greater than about 1 ms.

17. The system of claim 11 wherein the object is an aircraft having a surface.

18. The system of claim 17 wherein the aircraft is adapted to operate in a transonic regime.

19. The system of claim 17 wherein the aircraft is adapted to operate in a supersonic regime.

20. The system of claim 17 wherein the aircraft is adapted to operate in a hypersonic regime.

* * * * *